US005437459A

United States Patent [19]

Kirby

[11] Patent Number: 5,437,459

[45] Date of Patent: Aug. 1, 1995

[54] HORSE RACING GAMES WITH BOARD, PIECES, CARDS AND DICE

[76] Inventor: Gerald Kirby, 7723 Venture Road, Regina, Saskatchewan, Canada, S4Y 1C2

[21] Appl. No.: 195,437

[22] Filed: Feb. 14, 1994

[51] Int. Cl.[6] ..... A63F 3/00

[52] U.S. Cl. ..... 273/246; 273/281; 273/86 A

[58] Field of Search ..... 273/246, 86 C, 86 A, 273/86 R, 281, 282.1

[56] References Cited

U.S. PATENT DOCUMENTS

| | | | |
|---|---|---|---|
| 750,545 | 1/1904 | Keen | 273/86 C |
| 1,716,235 | 6/1929 | Manning | 273/86 C |
| 4,057,254 | 11/1977 | Girres | 273/282.1 |
| 4,708,348 | 11/1987 | Zaruba et al. | 273/246 |
| 4,729,568 | 3/1988 | Welsh | 273/246 |

FOREIGN PATENT DOCUMENTS

| | | | |
|---|---|---|---|
| 1263875 | 12/1989 | Canada | 273/246 |
| 361655 | 9/1906 | France | 273/86 C |
| 462710 | 4/1935 | United Kingdom | 273/86 C |

*Primary Examiner*—Benjamin H. Layno

[57] ABSTRACT

A horse racing game for use with cards and dice comprising, in combination, board pieces in a horse-like shape at the upper extents and an enlargement at their lower extents and a narrow neck therebetween, a board having a lower plate and an upper plate of similar shape and parallel vertical side walls coupling the upper and lower plates, a plurality of parallel slots formed from one end of the upper plate to adjacent the opposite end of the upper plate, the opposite end of the upper plate constituting the finish line with the board having a rectangular section at its lower extent and a triangular section at its upper extent whereby the central slot is longer than each adjacent side slot with the shortest side slots located outermost from the central slot adjacent to the side walls, the upper surface being provided with indicia indicating the number of the lane and with point amounts and the starting line adjacent to the midpoint of the rectangular section whereat the pieces are located to start play whereby when the cards are dealt and the dice are rolled, each player in succession may move his piece along the slot toward the finish line where the first player reaching the finish being the winner.

1 Claim, 3 Drawing Sheets

HORSE RACING GAMES WITH BOARD, PIECES, CARDS AND DICE

BACKGROUND OF THE INVENTION

1. Field of the Invention

The present invention relates to horse racing games with board, pieces, cards and dice and more particularly pertains to testing player's skill and chance with board games patterned after horse racing.

2. Description of the Prior Art

The use of board games is known in the prior art. More specifically, board games heretofore devised and utilized for the purpose of entertaining players are known to consist basically of familiar, expected and obvious structural configurations, notwithstanding the myriad of designs encompassed by the crowded prior art board which have been developed for the fulfillment of countless objectives and requirements.

A wide variety of prior art games are known. By way of example, U.S. Pat. Nos. 4,033,587 to Olliver and 5,106,098 to Filiczkowski disclose horse related board games with a curved path of travel for the horse like pieces.

Generally rectangular boards for horse related games are disclosed in U.S. Pat. Nos. 4,986,546 to Cerulla; 5,149,101 to Mazza and 3,963,243 to Contento. In the Mazza and Cerulla games, the pieces move linearly while the Contento game pieces move around the periphery of the board.

Lastly, U.S. Pat. No. 4,729,568 to Welsh discloses a horse related board game wherein the playing area includes a triangular zone.

In this respect, the horse racing games with board, pieces, cards and dice according to the present invention substantially depart from the conventional concepts and designs of the prior art, and in so doing provides an apparatus primarily developed for the purpose of providing entertainment to players.

Therefore, it can be appreciated that there exists a continuing need for new and improved horse racing games with board, pieces, cards and dice which can be enjoyed by any number of players. In this regard, the present invention substantially fulfills this need.

SUMMARY OF THE INVENTION

In view of the foregoing disadvantages inherent in the known types of board games now present in the prior art, the present invention provides improved horse racing games with board, pieces, cards and dice. As such, the general purpose of the present invention, which will be described subsequently in greater detail, is to provide new and improved horse racing games with board, pieces, cards and dice apparatus and method which has all the advantages of the prior art and none of the disadvantages.

To attain this, the present invention essentially comprises a new and improved horse racing game comprising, in combination, a deck of cards, a pair of dice, board pieces in a horse-like shape at the upper extents and an enlargement at their lower extents and a narrow neck therebetween, a board having a lower plate and an upper plate of similar shape and parallel vertical side walls coupling the upper and lower plates, a plurality of parallel slots formed from one end of the upper plate to adjacent the opposite end of the upper plate, the opposite end of the upper plate constituting the finish line with the board having a rectangular section at its lower extent and a triangular section at its upper extent whereby the central slot is longer than each adjacent side slot with the shortest side slots located outermost from the central slot adjacent to the side walls, the upper surface being provided with indicia indicating the number of the lane and with point amounts and the starting line adjacent to the midpoint of the rectangular section whereat the pieces are located to start play whereby when the cards are dealt and the dice are rolled, each player in succession may move his piece along the slot toward the finish line where the first player reaching the finish being the winner.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved horse racing games with board, pieces, cards and dice which have all the advantages of the prior art board games and none of the disadvantages.

It is another object of the present invention to provide new and improved horse racing games with board, pieces, cards and dice which may be easily and efficiently manufactured and marketed.

It is a further object of the present invention to provide new and improved horse racing games with board, pieces, cards and dice which are of a durable and reliable construction.

An even further object of the present invention is to provide new and improved horse racing games with board, pieces, cards and dice which are susceptible of a low cost of manufacture with regard to both materials and labor, and which accordingly are then susceptible of low prices of sale to the consuming public, thereby making such horse racing game with board, pieces, cards and dice economically available to the buying public.

Still yet another object of the present invention is to provide new and improved horse racing games with board, pieces, cards and dice which provide in the apparatuses and methods of the prior art some of the advantages thereof, while simultaneously overcoming some of the disadvantages normally associated therewith.

Yet another object of the present invention is to simulate horse racing by the simple use of a board, pieces, cards and dice.

Even still another object of the present invention is to provide new and improved horse racing game comprising, in combination, board pieces in a horse-like shape at the upper extents and an enlargement at their lower extents and a narrow neck therebetween, a board having a lower plate and an upper plate of similar shape and parallel vertical side walls coupling the upper and lower plates, a plurality of parallel slots formed from one end of the upper plate to adjacent the opposite end of the upper plate, the opposite end of the upper plate constituting the finish line with the board having a rectangular section at its lower extent and a triangular section at its upper extent whereby the central slot is longer than each adjacent side slot with the shortest side slots located outermost from the central slot adjacent to the side walls, the upper surface being provided with indicia indicating the number of the lane and with point amounts and the starting line adjacent to the midpoint of the rectangular section whereat the pieces are located to start play whereby when the cards are dealt and the dice are rolled, each player in succession may move his piece along the slot toward the finish line where the first player reaching the finish being the winner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
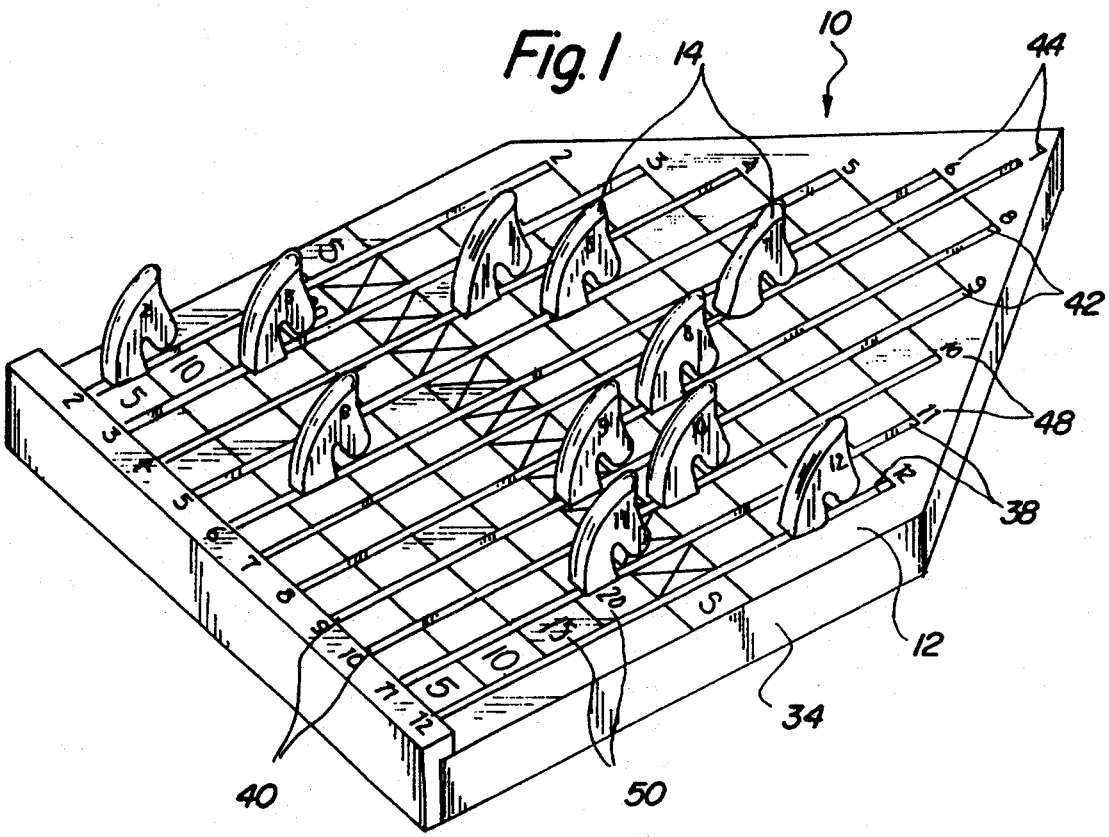
FIG. 1 is a perspective view of the preferred embodiment of the game board and game pieces of the horse racing game with board, pieces, cards and dice constructed in accordance with the principles of the present invention.
Figure 2:
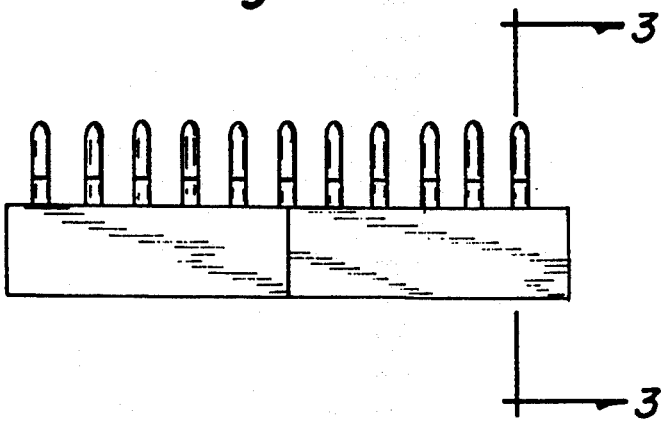
FIG. 2 is a front elevational view of the apparatus shown in FIG. 1.
Figure 3:
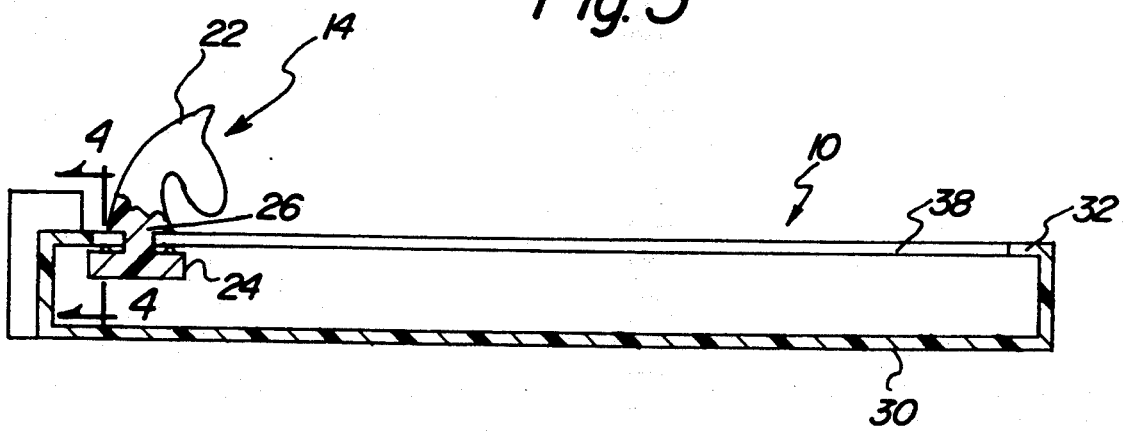
FIG. 3 is a cross-sectional view taken along line 3—3 of FIG. 2.

With reference now to the drawings, and in particular to FIG. 1 thereof, a new and improved horse racing game with board, pieces, cards and dice embodying the principles and concepts of the present invention and generally designated by the reference numeral 10 will be described.

Figure 4:
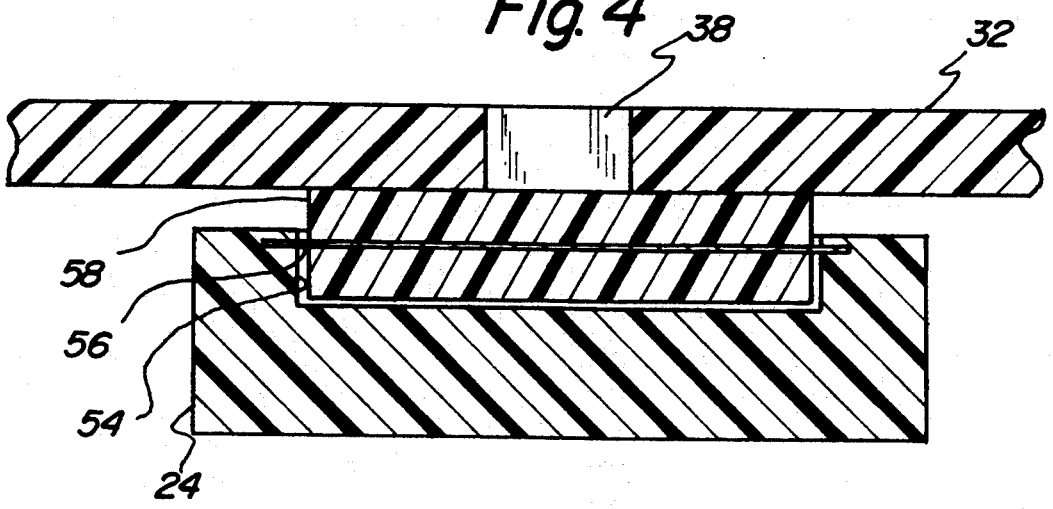
FIG. 4 is an enlarged sectional view taken along line 4—4 of FIG. 3.
Figure 5:
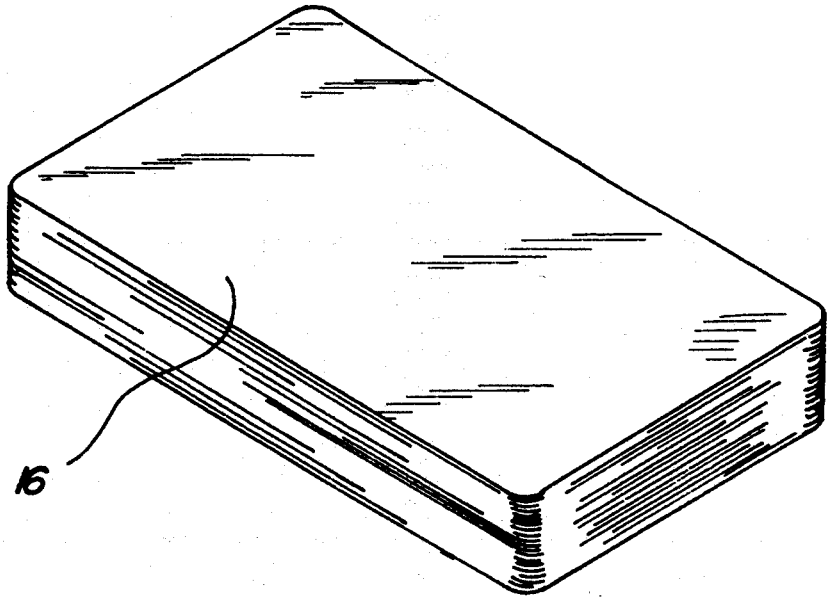
FIG. 5 is a perspective showing of a deck of playing cards required for the playing of the game.
Figure 6:
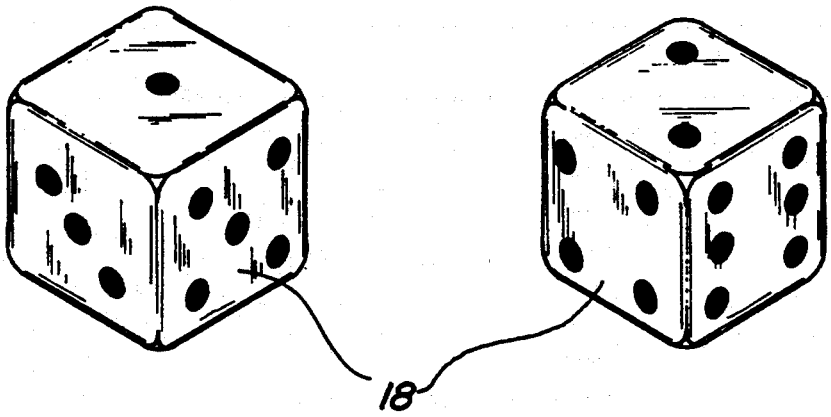
FIG. 6 is a perspective illustration of the dice used in playing the present game.

More specifically, it will be noted that FIGS. 1 through 4 along with FIGS. 5 and 6 illustrate the present invention which includes, in its broadest terms, a board 12, pieces 14, cards 16 and dice 18. FIGS. 5 and 6 illustrate a deck of cards 16 which is conventional having four suits with thirteen cards in each suit as well as a pair of dice 14 which are also conventional, each with six faces in the form of a cube and with marks on each face designating one, two, three, four, five and six. The next major components of the game are the board pieces 14. The board pieces are shaped in a horse-like configuration at the upper extents 22. An enlargement is formed at their lower extents 24. A narrow neck 26 is located between their upper and lower extents.

The final component of the game is the board 12. The board has a lower plate 30, an upper plate 32 having a similar periphery, and parallel vertical side walls 34 coupling the upper and lower plates. Formed into the upper plate 32 are a plurality of parallel slots 38. The slots are formed from one end 40 the upper plate to adjacent the opposite end 42 of the upper plate. The opposite end 42 constitutes the finish line 44. The board has a rectangular section at its lower extent and a triangular section at its lower extent and a triangular section at its upper extent. Consequently the central slot is longer than each adjacent side slot with the shortest slots located outermost from the central slot adjacent to the side walls 3. The periphery of the game board is remote from the finish line is removable for inserting and or removing the pieces. The upper surface is provided with indicia 48 indicating the number of the lane. The indicia also indicates point amounts 50. Other indicia is the starting line extending across a central extent of the rectangular section. The pieces are initially located at the starting line whereby when the cards are dealt and the dice are rolled, each player in succession moves his piece along the slot toward the finish line. The first player reaching the finish is the winner.

An alternate embodiment of the invention is shown in FIG. 4. In such embodiment, a pair of parallel rectangular recesses 54 are formed into the upper surface of the enlargement at the lower extent 24 of each piece 14. A pin 56 spans each recess to rotatably support a roller 58. The upper surface of the rollers are above the upper surface of the enlargement. Such an arrangement allows for smooth rolling of the piece along the slot of the game board during playing of the game.

The present invention is a unique game which simulates the excitement of real horse races. It features a pentagonal, five-sided, playing board with pieces formed as movable horses. The pieces are numbered two through twelve. The horses slide forward and backward in their own lanes. Cent values of $ 0.05, 0.10, 0.15 and 0.20 are located along the sides of the board for scratched horses. The starting line is five spaces from the bottom of the board whereat all horses are first lined up. The finish line location varies depending upon each horses lane with horse number 7 having the farthest to go. Numbers 6 and 8 have the next longest lanes, and so on.

To play the game, the aces and kings should be removed from the card deck. All remaining cards are dealt to the players, which can be any number of persons. The two dice are rolled to determine scratches or horses which will not run. The first roll of the dice creates a scratch payment of $0.05 for that numbered horse and the horse is moved backwards. Each roll creates a payment of the next-highest amount and another backwards movement for the appropriate horse. Players take turns rolling the dice for scratches to determine the horses which will be out of the race.

Play then continues by rolling the dice in turn. If a player rolls a scratched horse, he or she must pay the amount at which the horse scratched. If a player rolls the number of a horse which is still in the race, he or she moves that horse forward one space.

The horse which gets to the top of board first wins the game. The players who hold cards which match that horse's number will split the money accumulated in the pot. For example, in a game won by Horse Number 7 if four persons were playing and each one held a number 7 card, each would get 25% of the pot. If only two persons were playing, and one held three number 7 cards while the other player held the fourth number 7 card, a 75%/25% split of the pot would take place.

The steps in playing the game include first taking the aces and kings out of a standard deck of cards. The remaining cards are then all dealt to the players. Up to 8 (eight) people can play. Two dice are rolled to determine scratches. First roll scratches pay 5 cents, and the horse moves backwards. Second, third and fourth roll scratches pay 10, 15 and 20 cents respectively while the horse moves backwards. Scratched horses are then out of the race.

Anyone can roll dice for scratches, taking turns, while only remaining horses are in race. There are always four people taking turns rolling the dice. If scratched horse number is rolled, the roller pays whatever it scratched at. If a number is rolled of a horse in race, move the horse up 1 space. Whichever horse gets to top wins race, the four people who have that horse splits pot.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A horse racing game with board, pieces, cards and dice comprising, in combination:

a deck of cards;

a pair of dice;

a plurality of board pieces in a shape of a horse's head at the upper extents and an enlargement at their lower extents and a narrow neck therebetween, each enlargement having an upwardly facing recess;

a board having a lower plate with upper and lower surfaces and an upper plate with upper and lower surfaces and of similar shape and with parallel vertical side walls coupling the upper and lower plates, a plurality of parallel slots formed from one end of the upper plate to adjacent the opposite end of the upper plate, the upper extent of each board piece extends above said upper plate, the neck of each board piece extends through one of said slots, and only the enlargement of each board piece extends below said upper plate, between said upper plate and lower plate, the opposite end of the upper plate constituting the finish line with the board having a rectangular section at its lower extent and a triangular section at its upper extent whereby the central slot if longer than each adjacent side slot with the shortest side slots located outermost from the central slot adjacent to the side walls, the upper surface being provided with indicia between adjacent slots and additional indicia at both the upper and lower ends of each slot indicating the number of the lane and with point amounts and the starting line adjacent to the midpoint of the rectangular section whereat the pieces are located to start play whereby when the cards are dealt and the dice are rolled, each player in succession may move his piece along the slot toward the finish line where the first player reaching the finish line being the winner; and each enlargement consisting of a pair of rollers located within each recess with a pin spanning each recess for rotatably mounting each roller within a recess for rotation about an axis perpendicular to the slots, the rollers being in rolling contact with only the lower surface of the upper plate and no other portion of said enlargement being in contact with said upper or lower plates.

* * * * *